US007510104B2

(12) United States Patent
Taylor

(10) Patent No.: US 7,510,104 B2
(45) Date of Patent: Mar. 31, 2009

(54) FRAME-SUPPORTED PACKS

(75) Inventor: Mark Taylor, Marlborough (GB)

(73) Assignee: Lifemarque Limited, Berkshire (GB)

( * ) Notice: Subject to any disclaimer, the term of this patent is extended or adjusted under 35 U.S.C. 154(b) by 0 days.

(21) Appl. No.: 10/515,408

(22) PCT Filed: May 20, 2003

(86) PCT No.: PCT/GB03/02182

§ 371 (c)(1),
(2), (4) Date: Feb. 17, 2005

(87) PCT Pub. No.: WO03/096837

PCT Pub. Date: Nov. 27, 2003

(65) Prior Publication Data

US 2005/0133560 A1 Jun. 23, 2005

(30) Foreign Application Priority Data

May 21, 2002 (GB) ..... 0211594.7

(51) Int. Cl.
*A45F 3/00* (2006.01)
*A45F 3/04* (2006.01)
*A45F 4/02* (2006.01)
*A61G 1/00* (2006.01)

(52) U.S. Cl. ..... 224/633; 224/636; 224/630; 224/645; 224/153; 224/160; 224/161

(58) Field of Classification Search ..... 224/633, 224/636, 160, 161, 153, 630, 645
See application file for complete search history.

(56) References Cited

U.S. PATENT DOCUMENTS 2,792,980 A * 5/1957 Brown ..... 224/633
4,721,226 A * 1/1988 Yurko ..... 220/495.07
4,830,154 A * 5/1989 Gerch et al. ..... 190/103
4,885,812 A * 12/1989 Lindner ..... 5/113
4,895,230 A * 1/1990 King ..... 190/107
5,009,378 A * 4/1991 Linsmeyer et al. ..... 248/99
5,372,272 A * 12/1994 Jennings ..... 220/495.07
5,513,822 A * 5/1996 Gould ..... 248/99
5,615,853 A * 4/1997 Hearst ..... 248/99
5,626,271 A 5/1997 Messey et al.
5,954,248 A 9/1999 Jasper
5,964,470 A * 10/1999 Syendsen et al. ..... 280/30

(Continued)

FOREIGN PATENT DOCUMENTS

| | | | |
|---|---|---|---|
| DE | 35 41 394 A | | 9/1986 |
| EP | 0 662 292 | | 7/1995 |
| FR | 2728446 | * | 12/1994 |
| GB | 2202730 | * | 10/1988 |
| WO | WO 97 37529 A | | 10/1997 |
| WO | WO 02/078487 | | 10/2002 |

*Primary Examiner*—Nathan J Newhouse
*Assistant Examiner*—Lester L Vanterpool
(74) *Attorney, Agent, or Firm*—Davis & Bujold, P.L.L.C.

(57) ABSTRACT

A frame-supported back-pack for infant-carrying involves front and rear fabric-covered leaves (3,5) that hinge apart with the infant's seat (4) suspended between them. The front and rear leaves (3,5) are defined respectively by the upright section (8) of an L-shape tubular-metal member (7) and a tubular-metal member (11) hinged to the base section (9) of the L-shape member (7). A semicircular aperture (20) in the rear of the pack opens into the cavity (24) of a partially-domed shell (19) which is inset into the pack over part of the base section (9) of the L-shape member (7). The pack is held upright when standing on its base on the ground by insertion of the user's foot into the cavity (24) to press down onto the base section (9) under the aperture (20).

13 Claims, 5 Drawing Sheets

U.S. PATENT DOCUMENTS 5,975,389 A * 11/1999 Braun et al. ..... 224/155
5,988,476 A * 11/1999 Olerio ..... 224/630
6,098,857 A 8/2000 Le Gal
6,283,347 B1 9/2001 Roh
6,354,477 B1 3/2002 Trummer
6,536,641 B1 * 3/2003 Sundara et al. ..... 224/637

* cited by examiner

FRAME-SUPPORTED PACKS

This invention relates to frame-supported packs for carrying on the person.

The invention is particularly (though not exclusively) concerned with frame-supported back-packs of the kind for carrying an infant, but is applicable generally to frame-supported rucksacks and other packs carried on the back or front of a user.

According to the present invention there is provided a frame-supported pack for carrying on the person, having a base that enables the pack to stand upright on the ground for loading, unloading and/or adjustment, wherein an aperture is provided in the pack to enable a user to insert a foot into the pack over a part of the frame for exerting pressure downwardly on the frame to urge the base to the ground in holding the pack upright.

The present invention overcomes to a large extent the problem experienced during loading, unloading or adjusting a frame-supported pack when it is off the person, standing on the ground. The tendency in these circumstances is for the pack to topple over from the upright unless it is steadied in some way, and it is common in this regard for the user to lean the pack against their legs or to hold it upright between their knees, so that their hands are free for the loading, unloading or adjusting operation.

The above problem is especially troublesome, and gives rise to potential danger, in the circumstances where the pack is an infant-carrier, since both hands must, for safety, be free to hold the child while loading him/her into the carrier or unloading him/her from it. Also, while the infant is in the carrier, whether after loading or before unloading, both hands are normally required for adjusting or releasing straps and otherwise attending to the infant's welfare. This extends the danger of the carrier toppling with resultant injury or other trauma for the infant. However with the pack according to the invention, steadying to avoid toppling is readily achieved simply by the user inserting their foot into the aperture and pressing down. In this way, the pack is held positively in the upright condition, leaving both hands free for loading or unloading and for adjustment or release of straps, as required for safety or convenience and for otherwise attending to the needs of the infant.

The aperture of the pack according to the invention may be located in the rear of the pack and said part of the frame may extend across the rear of the pack beneath the aperture at the base. More particularly, the aperture, which may be substantially semicircular, may be the open mouth of a cavity that is defined within the pack. The cavity may be closed apart from at its open mouth, and may be of partially-domed form for ease of entry of the user's foot whether shod with shoe or boot; the cavity may be of a depth sufficient to accommodate the user's shoe or boot up to at least the ball of the foot.

The pack of the invention may include a seat for carrying an infant, and may have front and rear fabric-covered leaves that are hinged together at the base, with the seat suspended between them.

A frame-supported back-pack in accordance with the present invention, for carrying an infant, will now be described, by way of example, with reference to the accompanying drawings, in which.

Figure 1:
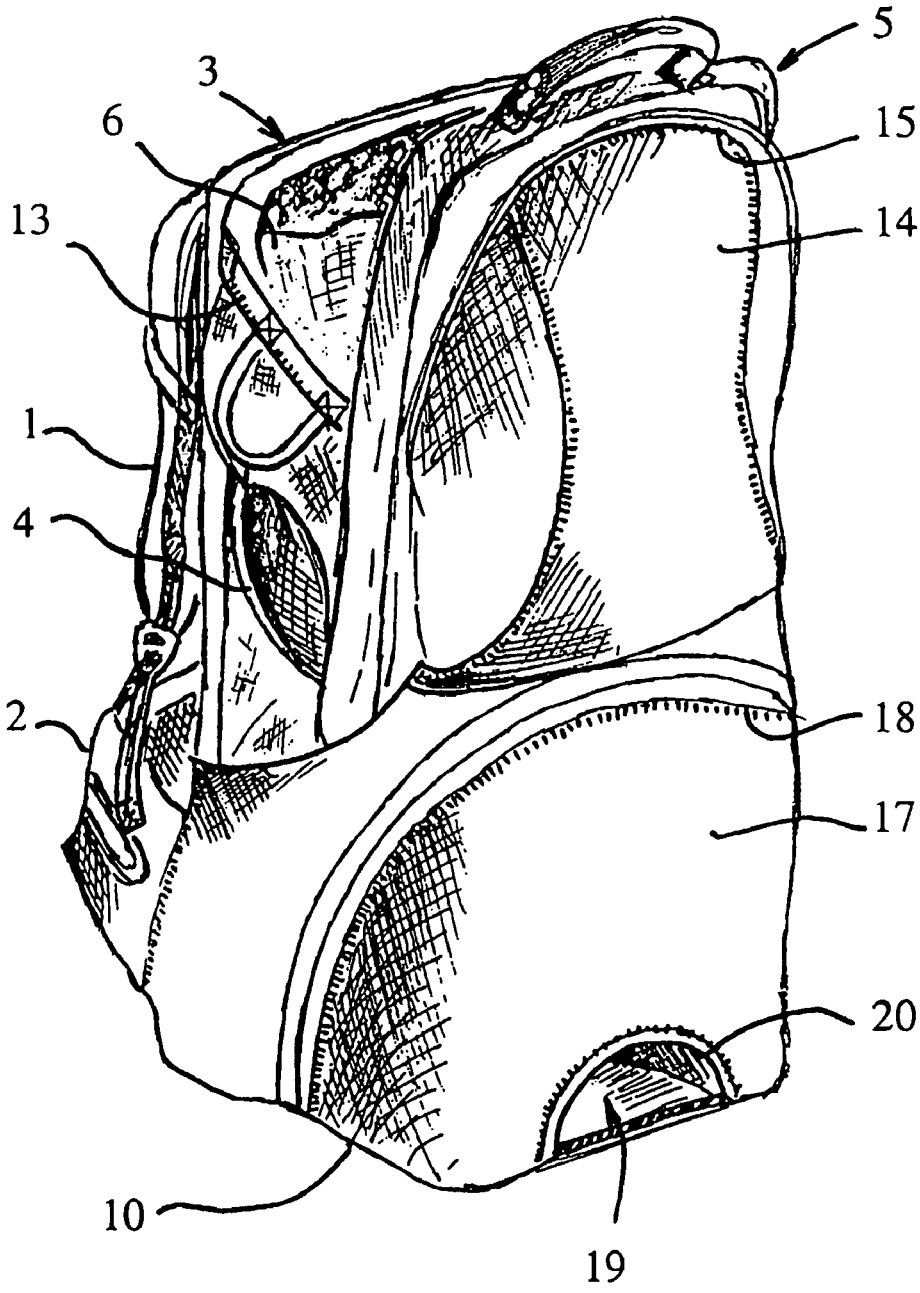
FIG. 1 is a perspective view from the rear of the infant-carrier back-pack of the invention.
Figure 2:
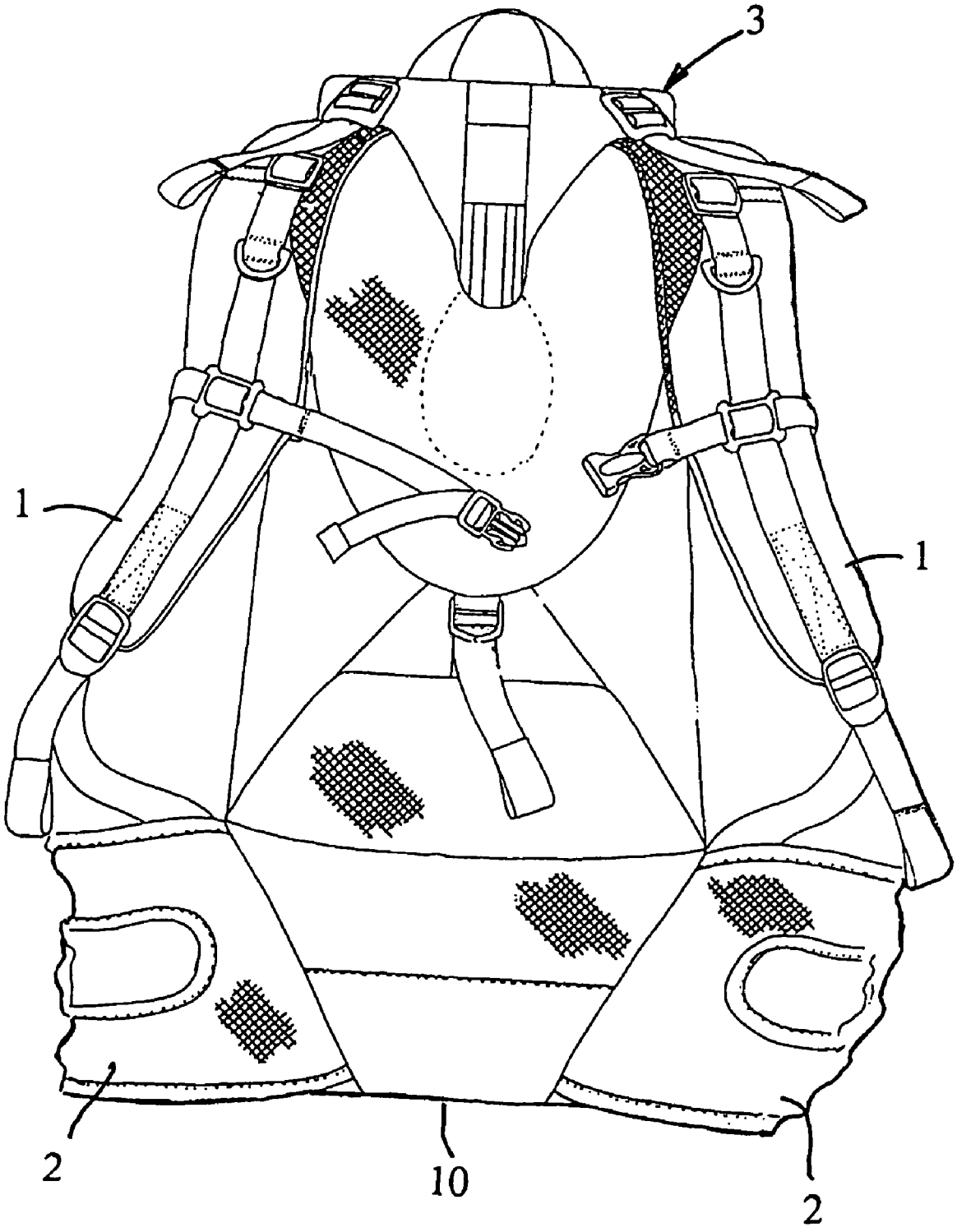
FIGS. 2 and 3 are front and rear views, respectively, of the infant-carrier back-pack.
Figure 3:
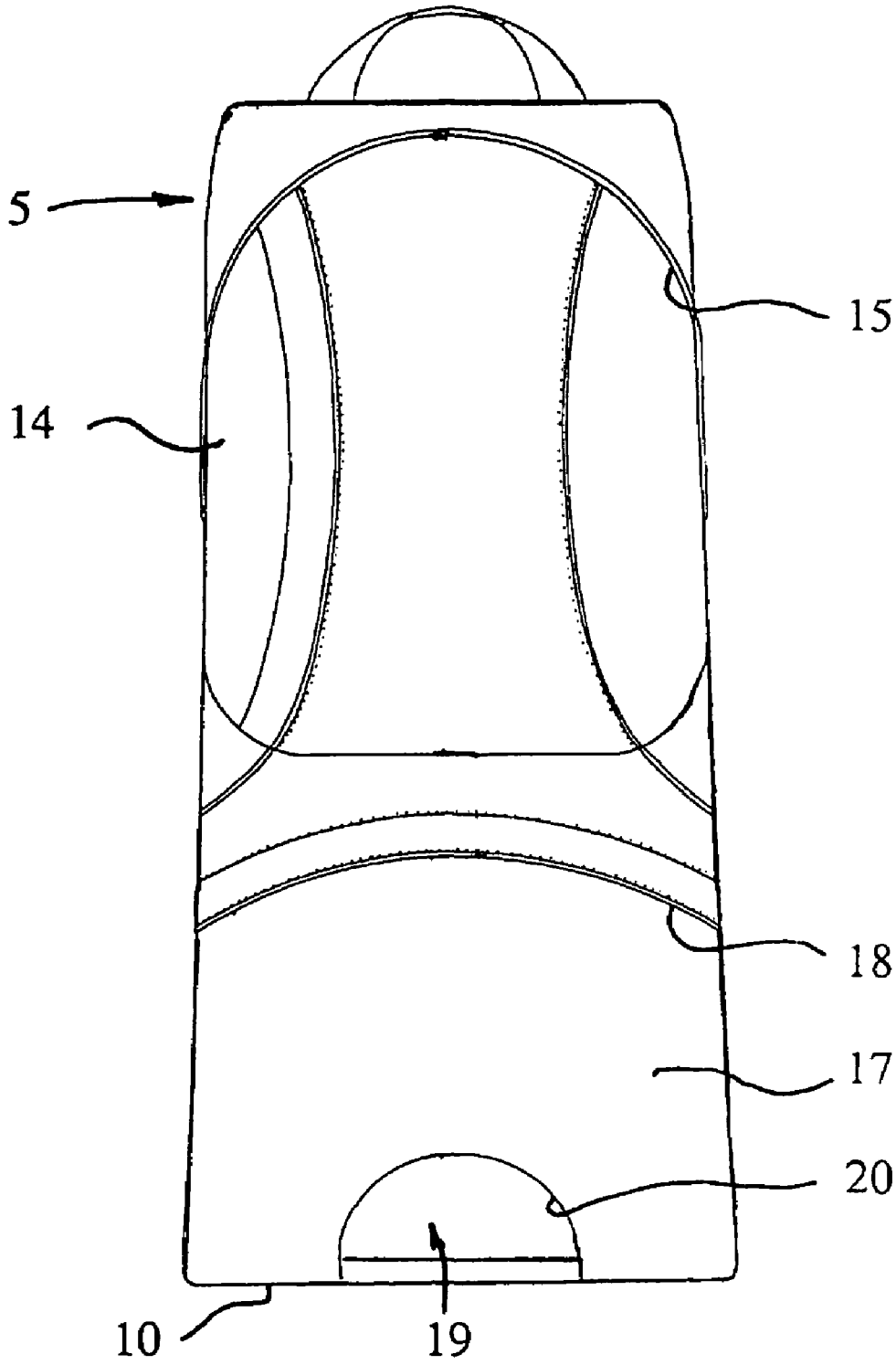
Figure 4:
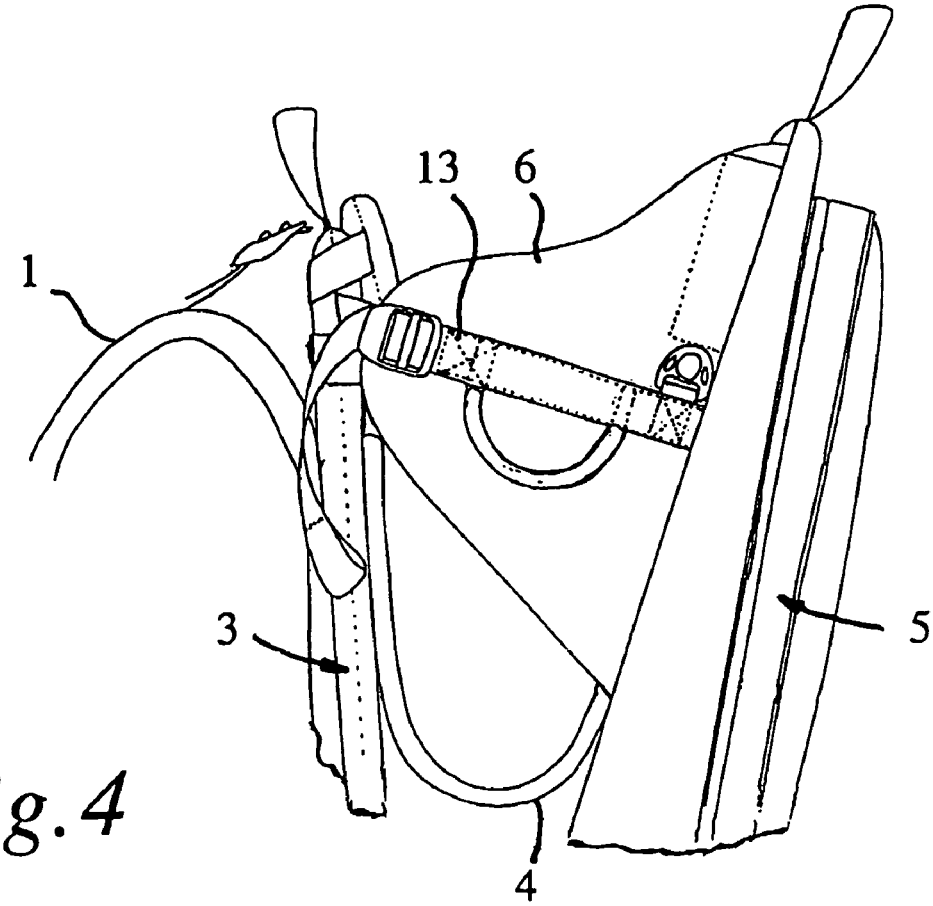
FIG. 4 is a partial side view of the infant-carrier back-pack.

Referring to FIGS. 1 to 4, the infant-carrier pack in this case is for mounting on the back of a user, and in this respect has two padded shoulder straps 1 and a padded waist-belt 2 for attaching the carrier to the user. The straps 1 and belt 2 are secured to the fabric of a fabric-covered frame that defines the overall structure of the carrier, being in this regard attached to a front leaf 3 of the structure, that is suitably padded for easy resting on the user's back.

A fabric seat 4 for accommodating the infant is suspended between a rear leaf 5 of the structure and the front leaf 3. The front and rear leaves 3 and 5 are padded, the rear leaf 5 to provide a back-rest to the seat 4, and the front leaf 3 for protection of the infant in the event of sudden forward movement. Straps (not shown) for securing the infant in the seat 4 between the leaves 3 and 5 are provided, together with padded wings 6 for side protection.

Figure 5:
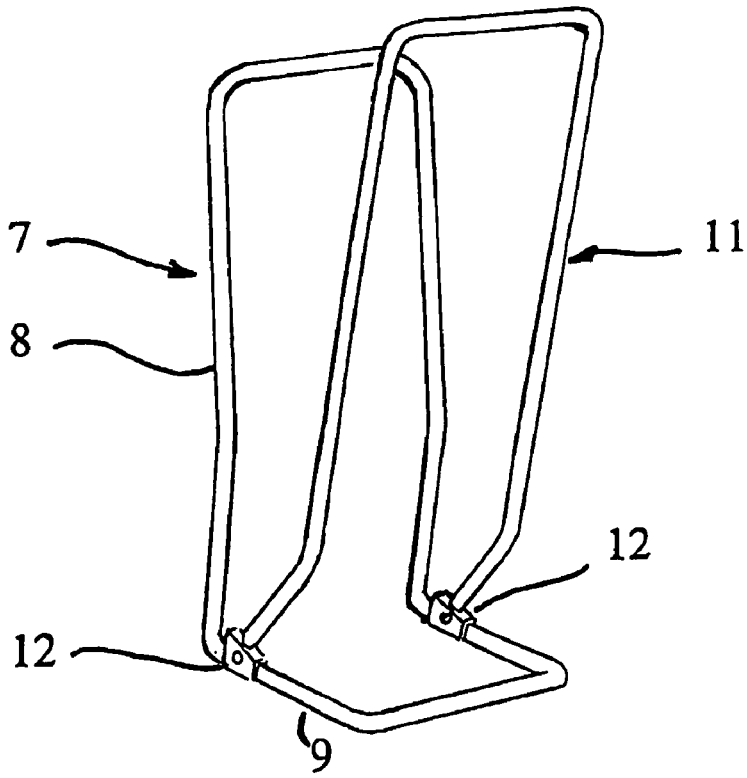
FIG. 5 is a perspective view to reduced scale of the supporting frame of the infant-carrier back-pack.

Referring now also to FIG. 5, the frame of the carrier involves a generally L-shape member 7 that is formed as an elongate, closed loop of tubular metal. The longer, upright section 8 of the L-shape member 7 is kinked forwardly slightly to define the front leaf 3, whereas its shorter, bottom section 9 gives structure to the fabric-covered base 10 of the carrier. The rear leaf 5 is defined by a tubular-metal member 11 of elongate U-configuration having its two ends coupled via hinges 12 to either side of section 9. The member 11 extends rearwardly from the hinges 12 and then kinks upwardly so that in the absence of an infant seated between them, the rear leaf 5 can be closed onto the front leaf 3.

The leaves 3 and 5 are contained entirely within a waterproof nylon fabric, and adjustable straps 13 are provided either side of the carrier for setting the extent to which the leaf 5 hinges rearwardly from the leaf 3. The setting of the straps 13 therefore determines the extent to which the infant when seated in the carrier can lean back.

Figure 6:
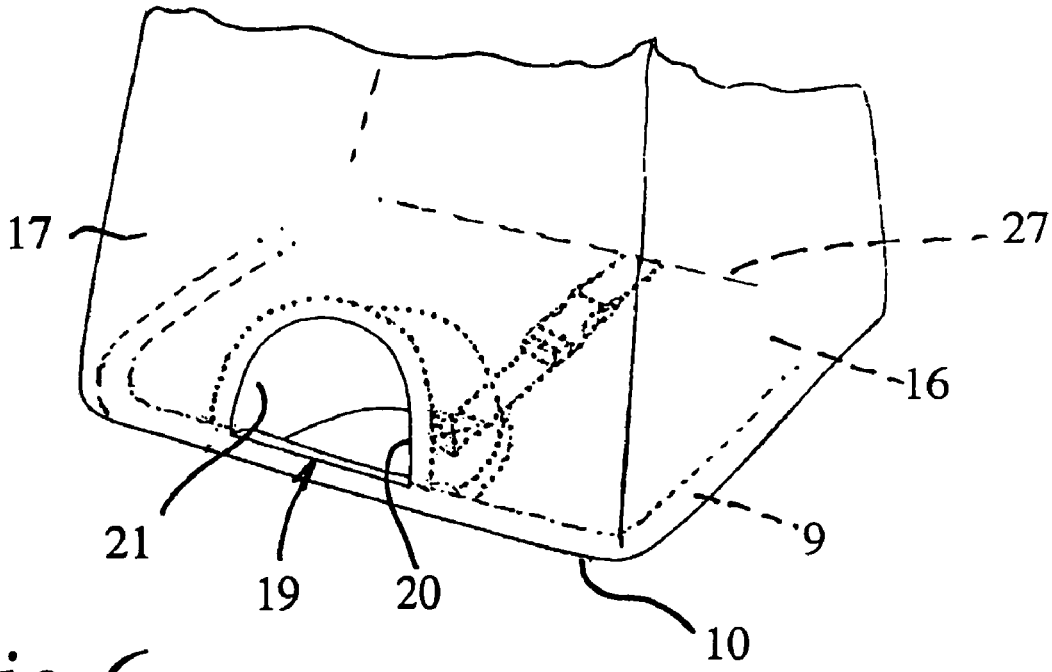
FIG. 6 is a perspective view from the rear of the base portion of the back-pack showing an anchor element that is incorporated into the infant-carrier back-pack in implementation of the invention.

A fabric pouch 14, which is open and closed by means of a zip fastener 15, is provided in the back of the rear leaf 5, and a further fabric-enclosed compartment 16 (FIG. 6) for stowing larger items, is located beneath the seat 4. Access to the compartment 16 is through a flap 17 that is opened and closed by a zip fastener 18 and as illustrated by FIG. 6 an anchor element 19 having a substantially-semicircular, open mouth 20 is sewn into the bottom of the flap 17 at the base 10. The mouth 20 is open externally to the rear of the carrier with the element 19 projecting into the compartment 16.

Figure 7:
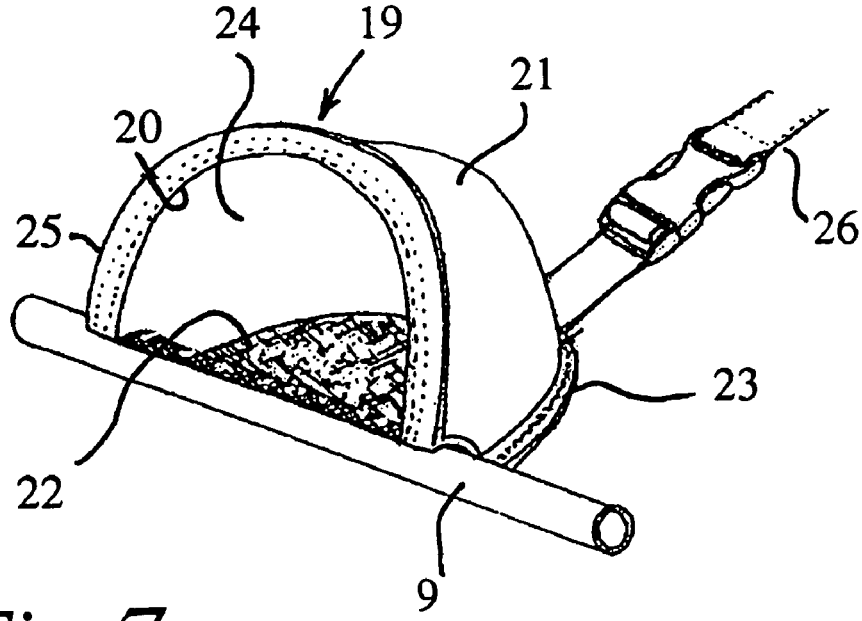
FIG. 7 is illustrative in greater detail of the anchor element a partial perspective-view within a compartment of the infant-carrier back-pack of the invention.

Referring now also to FIG. 7, the element 19 is formed by a partially-domed shell 21 of blow-moulded foam that is fabric-lined, and a floor-element 22 of a heavy-duty nylon-reinforced fabric. The fabric element 22 is stitched to a bottom-flange 23 of the shell 21 so as to define with the shell 21 a domed cavity 24 that is closed apart from at the mouth 20. The mouth 20 has a peripheral flange 25 that is stitched into the fabric of the flap 17, insetting the shell 21 into the rear of the pack over the frame section 9 at the base 10.

An adjustable strap 26, which is stitched at one end into a front seam 27 of the pack, is stitched at the other end to the floor-element 22 of the anchor element 19. The shell 21 seats on the bottom section 9 of the frame member 7, and tensioning of the strap 26 pulls the floor-element 22 together with the fabric of the flap 17, tightly round the frame-section 9. This maintains the cavity 24 presented fully open rearwardly with the floor-element 22 wrapped over the frame-section 9 within the mouth 20.

The aperture provided by the mouth 20 in the rear of the carrier, facilitates loading, unloading and adjustment of the carrier. In particular, when an infant is to be seated in the carrier, the carrier is stood upright with its base 10 on the ground and is held upright by the user simply by inserting his/her foot through the mouth 20 into the cavity 24 of the element 19. The user's foot presses down on the floor-element 22 holding the section 9 of the frame-member 7 in the base 10 hard to the ground, so that the carrier is not only restrained from toppling rearwardly, by the user's leg and foot, but also by the foot from toppling forwardly or sideways. Accordingly, the user can have both hands free for safe handling of the infant and loading and seating him/her in the carrier. Once the infant is seated and strapped securely in place any adjustments for comfort and safety can be made with both hands without fear of the carrier falling over, under the stability afforded by the foot-hold. When the carrier is to be lifted, the foot is removed to release this hold and the carrier placed on the user's back.

The foot-hold is also used whenever the carrier is removed from the user's back and placed on the ground for adjustment, or for attention to the needs or comfort of the infant or his/her removal from the carrier. In each case, once the user has inserted their foot into the mouth 20 and pressed down, the carrier remains upright, leaving both hands free to deal with the task involved.

The open mouth 20 of the element 19 (for example having a height of some 90 to 100 millimeter and width of some 125 to 130 millimeter) is sufficient to receive the user's foot whether shod with shoe or boot, and the depth of the cavity is sufficient (for example, some 100 millimeter) to allow the shoe or boot to be inserted at least to bring the ball of the foot over the section 9 of the member 7, in holding it down.

Although the invention has been described above in the context of an infant-carrier, it is applicable more widely than this. It has application in the context of any back- or front-carried rucksack or other pack that requires steadying when placed on the ground for loading, unloading or adjustment.

The invention claimed is:

1. A frame-supported backpack for a user in carrying a load, the frame-supported backpack being of a configuration tending to topple when standing in an upright condition on a ground-surface while carrying the load, and the frame-supported backpack comprising: a frame structure, the frame structure comprising an L-shape frame having an upright frame-section and a bottom frame-section integral with the upright frame-section, the bottom frame-section projecting from the upright frame-section to have a free end of the bottom frame-section spaced from the upright frame-section; a base on which the frame-supported backpack to stands on the ground-surface in the upright condition during one of loading, unloading and adjustment, the base including the free end of the bottom frame-section of the L-shape frame; a load-receiving means supported on the frame structure; an outer wall of the frame-supported backpack that extends upwardly from the base when the frame-supported backpack stands in the upright condition on the ground-surface as aforesaid; an attachment means for attaching the frame-supported backpack to the user; and a cavity-defining means for defining a cavity located within the outer wall at the base of the end of the frame-supported backpack, the cavity-defining means including a floor-part overlying the free end of the bottom frame-section in the base, and the cavity having an open mouth that is defined by an aperture through the outer wall to enable the user to insert a foot through the open mouth of the cavity onto the floor-part of the cavity-defining means for exerting pressure downwardly on the free end of the bottom frame-section in urging the base onto the ground-surface to hold the frame-supported backpack in the upright condition on the ground-surface, and wherein the cavity is closed apart from at its open mouth through the outer wall.

2. The frame-supported backpack according to claim 1 wherein the outer wall is a rear wall of the frame-supported backpack.

3. The frame-supported backpack according to claim 2, wherein the bottom frame-section extends across the rear of the frame supported backpack beneath the open mouth in the rear wall.

4. The frame-supported backpack according to claim 1, wherein the outer wall has a fabric covering, and the cavity-defining means is attached to the fabric covering of the outer wall.

5. The frame-supported backpack according to claim 1, wherein the open mouth of the cavity is substantially semi-circular.

6. The frame-supported backpack according to claim 1, wherein the floor-part is of fabric and is tensioned to maintain the cavity presented open over the bottom frame-section.

7. The frame-supported backpack according to claim 1, wherein the cavity is of a partially-domed form.

8. A backpack for a user carrying an infant, the backpack comprising: a frame structure, the frame structure having a bottom frame-section, a front frame-section for defining a front wall of the backpack, and a rear frame-section for defining a rear wall of the backpack; a seat for carrying the infant, the seat being attached to the frame structure; a base to enable the backpack to stand upright on a ground-surface for the user to attend to the infant while the infant is seated in the seat, the base including the bottom frame-section of the frame structure, and the rear wall extending upwardly from the base when the backpack stands upright on the ground-surface as aforesaid; an outer wall covering to the rear wall of the frame structure; cavity-defining means attached below the seat to the base for defining a cavity within the backpack, the cavity-defining means having a floor-part at a level within the backpack overlying the bottom frame-section within the base, and the cavity having an open mouth that is defined by an aperture in the outer wall covering of the rear wall of the frame structure, the aperture opening through the rear wall of the frame structure at the level of the floor-part within the backpack to enable the user to insert a foot through the open mouth onto the floor-part for exerting pressure downwardly on the bottom frame-section in urging the base onto the ground-surface for holding the backpack upright.

9. The backpack according to claim 8, wherein the frame structure of the backpack has front and rear fabric-covered leaves that are hinged together at the base, and the seat is suspended between the leaves.

10. The backpack according to claim 9, wherein the frame structure involves a generally-L shape member that comprises the bottom frame-section and a longer, upright section that is upstanding from the bottom frame-section, the front leaf is defined by the upright section, and the rear leaf is defined by a member that is hinged to the bottom frame-section.

11. The backpack according to claim 9, wherein a portion of the bottom frame-section extends across a rear of the base of the backpack under the aperture, and the aperture opens through the fabric covering of the rear leaf.

12. The backpack according to claim 9, wherein the frame structure is of tubular metal.

13. The backpack according to claim 9, wherein the aperture is defined by an open mouth of a partially-domed shell inset over the bottom frame-section into the rear leaf of the backpack.

* * * * *